US005184938A

United States Patent [19]

Harmsen

[11] Patent Number: 5,184,938

[45] Date of Patent: Feb. 9, 1993

[54] AXIAL FAN WITH A CYLINDRICAL OUTER HOUSING

[75] Inventor: Siegfried Harmsen, Georgen, Fed. Rep. of Germany

[73] Assignee: Papst-Motoren GmbH & Co., KG, St. Georgen, Fed. Rep. of Germany

[21] Appl. No.: 708,132

[22] Filed: May 30, 1991

[30] Foreign Application Priority Data

May 31, 1990 [DE] Fed. Rep. of Germany ..... 9006174

[51] Int. Cl.[5] ..... B63H 1/26

[52] U.S. Cl. ..... 416/223 R; 416/DIG. 2; 416/DIG. 5; 415/119

[58] Field of Search ..... 415/119; 416/223 R, 416/DIG. 2, DIG. 5

[56] References Cited

U.S. PATENT DOCUMENTS

| | | | |
|---|---|---|---|
| 2,578,806 | 12/1951 | Johnson | 416/223 |
| 3,023,709 | 3/1962 | Kondo | 416/223 |
| 4,569,631 | 2/1986 | Gray, III | 416/DIG. 2 |
| 4,684,324 | 8/1987 | Perosino | 416/DIG. 2 |
| 4,729,714 | 3/1988 | Wrobel | 415/119 |
| 4,767,262 | 8/1988 | Simon | 415/119 |
| 4,840,541 | 6/1989 | Sakane et al. | 415/119 |

FOREIGN PATENT DOCUMENTS

| | | | |
|---|---|---|---|
| 0115470 | 12/1929 | Austria | 416/223 R |
| 0203428 | 5/1959 | Austria | 416/223 R |
| 0074292 | 12/1944 | Czechoslovakia | 416/223 R |
| 2226177 | 12/1973 | Fed. Rep. of Germany . | |
| 0115911 | 10/1978 | Japan | 416/223 R |
| 683012 | 11/1952 | United Kingdom | 416/223 R |

*Primary Examiner*—Thomas E. Denion
*Attorney, Agent, or Firm*—Finnegan, Henderson, Farabow, Garrett & Dunner

[57] ABSTRACT

The invention relates to an axial fan with an essentially cylindrical outer housing and with a fan wheel which rotates therein and the hub of which is located on the rotor of an electric drive motor, the stator of the drive motor being held by webs extending on the delivery side relative to the outer housing. The vanes of the axial fan are radially twisted and possess a forward curvature with a camber varying from the hub cross-section to the outer cross-section. In order to achieve a pressure increase, at the same time with a reduction of the operating noise, the vanes have in the hub region a cross-section designed for a low flow per unit volume and small pressure increase, but in the outer region a cross-section designed for higher values of flow per unit volume and pressure increase.

19 Claims, 2 Drawing Sheets

AXIAL FAN WITH A CYLINDRICAL OUTER HOUSING

Background of the Invention

The invention relates to an axial fan with an essentially cylindrical outer housing and with a fan wheel which rotates therein. The hub of the axial fan is located on the rotor of a centrally arranged electric drive motor. The stator of the drive motor is held by webs extending on the delivery side relative to the outer housing, and the radially twisted vanes of which have a forward curvature with a camber changing from the hub cross-section to the outer cross-section.

Fans of this type are installed, for example, in personal computers and other electronic appliances for the purpose of generating a flow of cooling air. Since such appliances are often operated on office desks and at comparable work stations, the noise emission associated with the generation of the flow of cooling air is a considerable factor. The set object of fans these cooling is, therefore, not only to generate a sufficient flow of air per unit volume with an increase of pressure to overcome the flow resistance predetermined by the appliance construction, but also at the same time to cause as little working noise as possible. Furthermore, the need to reduce production costs has also led to the manufacture of both the outer housing and the fan wheel from injection-molded plastic, whereas the outer housing was previously made from metal by diecasting and the fan wheel welded from sheet metal; this in turn has a bearing on the constructive design of the fan.

The fan wheel of the one known cooling fan possesses seven vanes. The cross-section in every circumferential plane from the hub to the outer edge is designed in terms of the same characteristic point. That is to say, the vanes are designed to produce the same flow per unit volume for a specific pressure increase. Consequently, the vane cross-section in the hub region has a high camber and at the same time a large setting angle (relative to the perpendicular to the axis); both the camber and the setting angle decrease towards the outside. At the same time, the cross-section lengthens according to the circumference which becomes larger.

It has been possible, during operation, for this fan to satisfy the expectations placed on it to only a limited extent. Although, in the free-blowing mode, the flow per unit volume seemed to point to the generation of a sufficient air circulation, use in practice under realistic conditions showed that the pressure increase was insufficient to maintain the necessary flow per unit volume against the resistance at the place of use.

SUMMARY OF THE INVENTION

The object of the invention is, therefore, to design an axial fan of the present type, in such a way as, whilst ensuring the greatest possible reduction of the operating noise, to obtain a pressure increase which, even under installation conditions, maintains the necessary flow of air per unit volume.

This object was achieved in that the vanes have in the hub region a cross-section designed for a low flow per unit volume and a small pressure increase, but in the outer region a cross-section designed for higher values of flow per unit volume and pressure increase, whilst the cross-sectional design in the intermediate region changes continuously and the vanes, having a relatively slight change of camber, are also on the whole only slightly twisted. An only moderate compression/volumetric-flow capacity (conveying capacity) in the near-hub region of the vanes, that is to say the lower circumferential speed, is thus as it were overcompensated in the outer region at a higher circumferential speed. It was shown that such a fan wheel in an essentially cylindrical outer housing permitting virtually no pressure increase as a result of radially directed acceleration components exhibits a distinctly more rigid volumetric-flow/pressure behavior than the known axial fan discussed above, that is to say the decrease of the flow per unit volume with a rising counter pressure and a corresponding pressure increase diminishes.

A further reduction of the noise, especially of the disagreeable frequency fractions, is obtained if, in a development of the invention, the leading and trailing edges of the vanes are sickle-shaped, the middle cross-section preferably having the greatest length. This effect is presumably attributable to the fact that neither the geometrical conditions of the vanes themselves nor of their relation to the webs are beneficial to the formation of air vibrations with specific frequencies or of beatings.

Preferably, starting from the hub, the leading edges extend first radially and further outwards curvedly with the direction of rotation, whilst the trailing edges preferably adjoin the hub forwards at an inclination and extend curvedly outwards from the middle portion oppositely to the direction of rotation.

Preferably, the vanes are arranged on the hub in an odd number, because it is thereby possible to eliminate noises which otherwise occur with even-numbered vanes as a result of the even-numbered circumferential division.

Preferably, the stator of the electric drive motor is held on the outer housing by an even number of webs, with the result that the undesirable noises can be further reduced.

Preferably, the forward curvature of the vanes decreases at an increasing distance from the hub, within a vane cross-section, that is to say, at a constant distance from the hub, the forward curvature preferably increases towards the trailing edge of the vanes. It was shown that a shaping of this type gives rise in an especially advantageous way to the radial dependence according to the invention of the flow per unit volume and of the pressure increase.

The drawing illustrates the invention by means of an exemplary embodiment, and in it:

Description of the Preferred Embodiment

Figure 1:
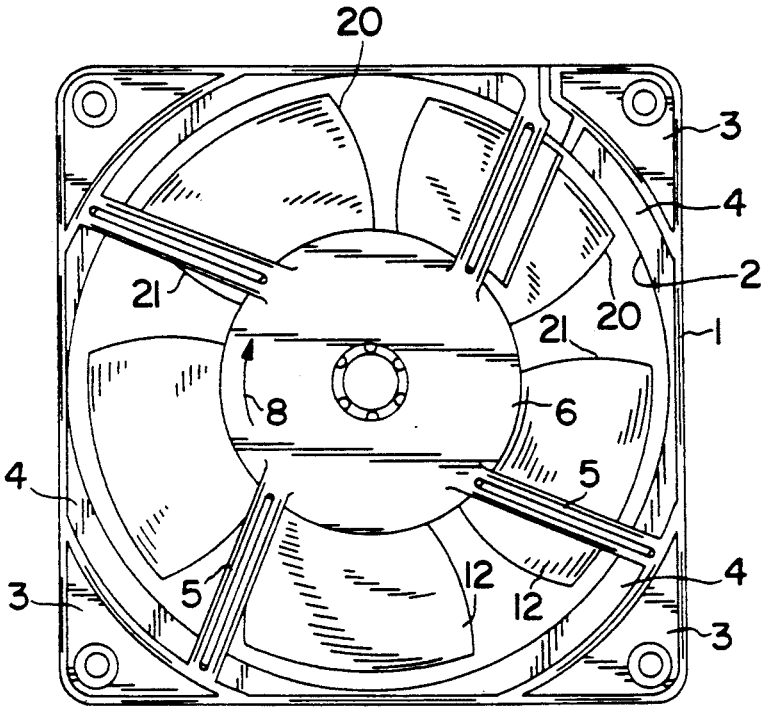
FIG. 1 shows a top view of the delivery side of the axial fan according to the invention.

Referring to FIG. 1, the outer housing 1 of the axial fan is in one piece and has a cylindrical portion 2 limited on the end face by formed-on flange portions 3 aligned with one another. In the corner regions of the delivery side, the cylindrical portion 2 merges into widenings 4. Attached to these are, for example, four webs 5 which, distributed uniformly over the circumference, extend parallel to the radius and which terminate in a central plate 6 carrying the stator (not shown) of the (electric) drive motor. Bores 7 in the corners of the flanges 3 serve for fastening the fan, for example in the housing of a visual display unit.

Figure 2:
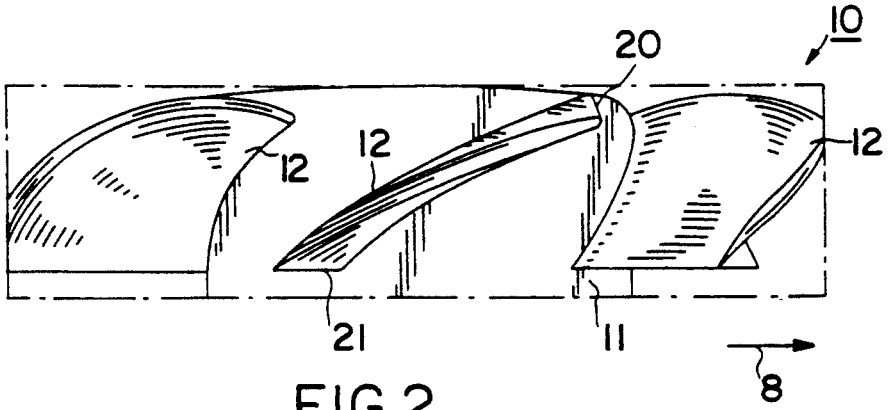
FIG. 2 shows a radial view of the fan wheel on an enlarged scale.

Referring to FIG. 2, the fan wheel, 10 has a hub 11. The diameter of the hub 11 is essentially equal to the diameter of the plate 6 and which engages in a pot-like manner over the stator of the electric motor fastened to the plate 6. The hub 11 is connected operatively to its rotor part. Fastened to the circumference of the hub 11, distributed not entirely uniformly in a known way, are, for example, five fan vanes 12 which have a configuration according to the invention. At the same time, the fan vanes 12, and the hub 11 are one piece which is produced by plastic injection-molding.

Figure 3:
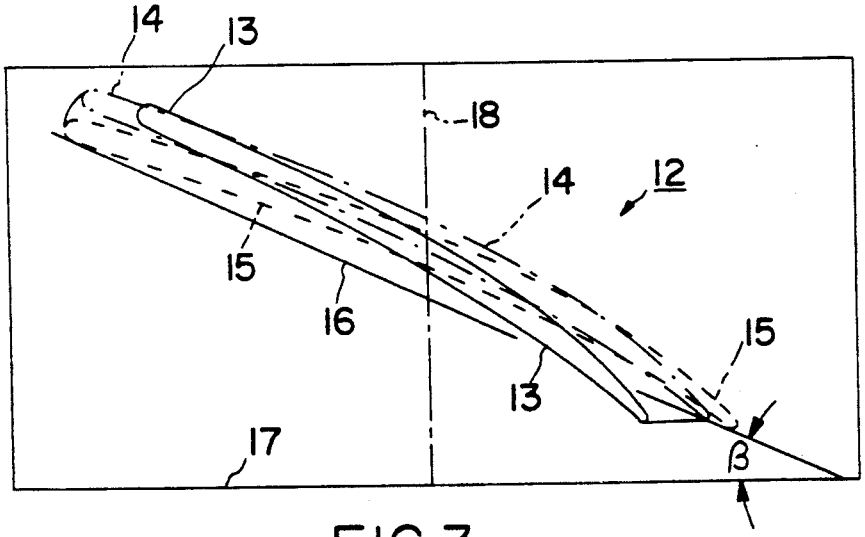
FIG. 3 shows the hub, middle and outer cross-sections of a fan-wheel vane in its relative position; and—for comparison—

FIG. 3 illustrates more clearly, as a top view of the blade 12 in the middle in FIG. 2, the differing cross-sectional design of the vanes in radially different circumferential planes (for opposite direction of rotation; see the arrow 8 representing the direction of rotation). In the hub region, the vane 12 adjoins the hub 11 with the cross-section 13. The middle profile has the cross-section 14, and the cross-section 15 thickly edged in FIG. 3 illustrates the vane profile on the outer circumference of the fan wheel. It is shown that both the camber, namely the maximum distance of the vane inner profile from the edge-connecting line 16, and the setting angle of this edge-connecting line relative to the perpendicular 17 to the axis 18 change only slightly in the three cross-sectional (circumferential) planes.

The camber has the form of a forward curvature which decreases at an increasing distance from the hub 11. At the same time, as seen in the cross-section of a vane, the forward curvature increases continuously from the leading edge 20 towards the trailing edge 21.

This configuration of the vane 12 is obtained when, in the design of the profile, lower values for the flow per unit volume and pressure increase are predetermined for the radially inner vane profile (in the hub region) than when fixing the configuration of the cross-section on the outer diameter; a suitable interpolation is carried out in between.

Figure 4:
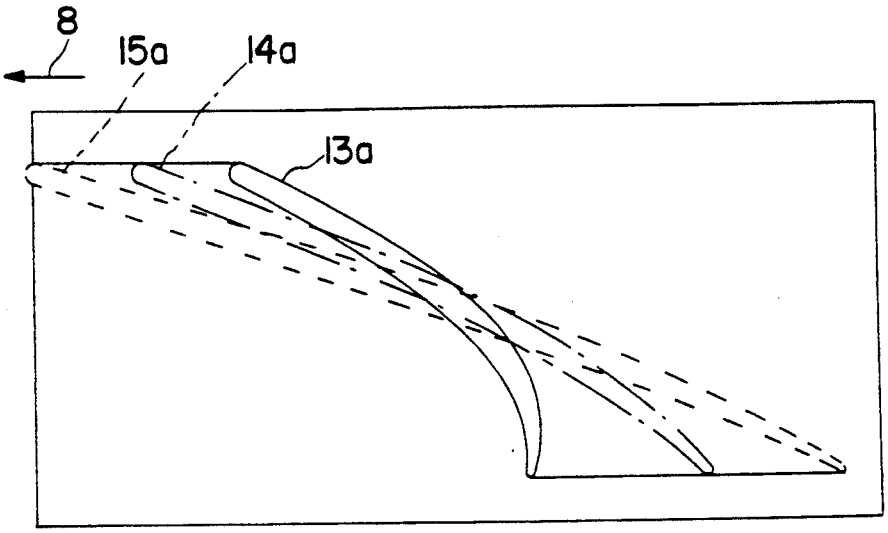
FIG. 4 shows the form and relative position of corresponding cross-sections in the generic state of the art.

For comparison, FIG. 4 shows the corresponding cross-sectional designs 13*a*, 14*a* and 15*a* of a vane for which the same characteristic values have been predetermined over its entire radial extension.

The top view of the vane wheel 10 in FIG. 1 illustrates the sickle-shaped form of the leading edges 20 and trailing edges 21 of each vane 12. Starting from the hub 11, the leading edges 20 extend first radially outwards and then curvedly oppositely to the direction of rotation, whilst the trailing edges 21 adjoin the hub 11 at an inclination rearwards and extend curvedly outwards from the vane middle portion with the direction of rotation. It follows from this that the vane cross-section 14 in the middle portion has the greatest length (FIG. 3).

Instead of the five fan vanes shown, another odd or even number of fan vanes 12 can also be provided. Furthermore, instead of the four illustrated webs 5 which retain the stator of the electric drive motor, another even or odd number of webs 5 can also be provided.

I claim:

1. An electric axial cooling fan for drawing air into a receiving side of the fan and for expelling air out of a delivery side of the fan, comprising:

an outer housing having a substantially cylindrical aperture;

a central plate in the substantially cylindrical aperture;

a plurality of webs on the delivery side of the fan, each web connecting the central plate to the outer housing;

a hub rotatable connected to the central plate; and a plurality of vanes connected to the hub so as to rotate with the hub;

each vane having a forward curvature with a camber changing from the hub cross-section to the outer cross-section;

each vane having means, relatively near the hub, for generating a relatively low flow per unit volume and a relatively small pressure increase, and having means, relatively away from the hub, for generating a relatively high value of flow per unit volume and a relatively large pressure increase, the cross-sectional design of each vane changing continuously, each vane having a relatively slight change of camber, and each vane being only slightly twisted; and the leading edge of each vane extending radially relatively near the hub and the leading edge of each vane curving opposite to the direction of rotation relatively away from the hub.

2. A fan as claimed in claim 1 wherein an odd number of vanes are provided and an even number of webs are provided.

3. A fan as claimed in claim 1 wherein an even number of vanes are provided and an odd number of webs are provided.

4. A fan as claimed in claim 1, wherein the leading and trailing edges of each of the vanes are sickle-shaped.

5. The fan as claimed in claim 1 wherein the forward curvature of each vane decreases at an increasing distance from the hub.

6. The fan as claimed in claim 1 wherein the forward curvature of each vane curves towards the tailing edge of the vane.

7. An electric axial cooling fan for drawing air into a receiving side of the fan and for expelling air out of a delivery side of the fan, comprising:

an outer housing having a substantially cylindrical aperture;

a central plate in the substantially cylindrical aperture;

a plurality of webs on the delivery side of the fan, each web connecting the central plate to the outer housing;

a hub rotatable connected to the central plate; and a plurality of vanes connected to the hub so as to rotate with the hub;

each vane having a forward curvature with a camber changing from the hub cross-section to the outer cross-section;

each vane having means, relatively near the hub, for generating a relatively low flow per unit volume and a relatively small pressure increase, and having means, relatively away from the hub, for generating a relatively high value of flow per unit volume and a relatively large pressure increase, the cross-sectional design of each vane changing continuously, each vane having relatively slight change of camber, and each vane being only slightly twisted; and the trailing edge of each vane adjoining the hub at an angle away from the direction of rotation and curving toward the direction of rotation relatively away from the hub.

8. A fan as claimed in claim 7 wherein an odd number of vanes are provided and an even number of webs are provided.

9. A fan as claimed in claim 7 wherein an even number of vanes are provided and an odd number of webs are provided.

10. A fan as claimed in claim 7, wherein the leading and trailing edges of each of the vanes are sickle-shaped.

11. The fan as claimed in claim 7 wherein the forward curvature of each vane decreases at an increasing distance from the hub.

12. The fan as claimed in claim 7 wherein the forward curvature of each vane curves towards the trailing edge of each vane.

13. The fan as claimed in claim 7 wherein the leading edge of each vane extends radially relatively near the hub and the leading edge of each vane curves opposite to the direction of rotation relatively away from the hub.

14. An electric cooling fan for drawing air into a receiving side of the fan and for expelling air out of a delivery side of the fan, comprising:

an outer housing having a substantially cylindrical aperture;

a central plate in the substantially cylindrical aperture;

a plurality of webs on the delivery side of the fan, each web connecting the central plate to the outer housing;

a hub rotatable connected to the central plate; and a plurality of vanes connected to the hub so as to rotate with the hub;

each vane having a forward curvature with a camber changing from the hub cross-section to the outer cross-section;

each vane having means, relatively near the hub, for generating a relatively low flow per unit volume and a relatively small pressure increase, and having means, relatively away from the hub, for generating a relatively high value of flow per unit volume and a relatively large pressure increase, the cross-sectional design of each vane changing continuously, each vane having a relatively slight change of camber, and each vane being only slightly twisted;

wherein each vane has the greatest cross-section length at the middle.

15. A fan as claimed in claim 14 wherein an odd number of vanes are provided and an even number of webs are provided.

16. A fan as claimed in claim 14 wherein an even number of vanes are provided and an odd number of webs are provided.

17. The fan as claimed in claim 14 wherein the forward curvature of each vane decreases at an increasing distance from the hub.

18. The fan as claimed in claim 14 wherein the forward curvature of each vane curves towards the trailing edge of the vane.

19. The fan as claimed in claim 14 wherein the leading edge of each vane extends radially relatively near the hub and the leading edge of each vane curves opposite to the direction of rotation relatively away from the hub.

* * * * *

UNITED STATES PATENT AND TRADEMARK OFFICE

CERTIFICATE OF CORRECTION

PATENT NO. : 5,184,938

DATED : February 9, 1993

INVENTOR(S) : Siegfried HARMSEN

It is certified that error appears in the above-identified patent and that said Letters Patent is hereby corrected as shown below:

Title page, in the name of the Assignee: change "Co., KG," to --Co. KG,--.

Claim 6, col. 4, line 41, change "tailing" to --trailing--.

Signed and Sealed this

Second Day of November, 1993

*Attest:*

Bruce Lehman

BRUCE LEHMAN

*Attesting Officer*

*Commissioner of Patents and Trademarks*